US006881930B2

(12) United States Patent
Yoshikawa et al.

(10) Patent No.: US 6,881,930 B2
(45) Date of Patent: Apr. 19, 2005

(54) GLOW PLUG AND METHOD OF MANUFACTURING THE SAME

(75) Inventors: Takaya Yoshikawa, Kasugai (JP); Nobutuki Hotta, Konan (JP); Shinya Murakoshi, Nagoya (JP); Hiroyuki Suzuki, Kasugai (JP)

(73) Assignee: NGK Spark Plug Co., Ltd. (JP)

( * ) Notice: Subject to any disclaimer, the term of this patent is extended or adjusted under 35 U.S.C. 154(b) by 0 days.

(21) Appl. No.: 10/764,089

(22) Filed: Jan. 23, 2004

(65) Prior Publication Data

US 2004/0178185 A1 Sep. 16, 2004

(30) Foreign Application Priority Data

Jan. 28, 2003 (JP) ..... 2003-019577
Nov. 4, 2003 (JP) ..... 2003-373860

(51) Int. Cl.[7] ..... F23Q 7/00
(52) U.S. Cl. ..... 219/270; 123/145 A
(58) Field of Search ..... 219/270, 544; 123/145 A, 145 R

(56) References Cited

U.S. PATENT DOCUMENTS 4,475,029 A * 10/1984 Yoshida et al. ..... 219/270
4,499,366 A 2/1985 Yoshida et al. ..... 219/270
4,931,619 A * 6/1990 Ogata et al. ..... 219/270
5,645,742 A * 7/1997 Schmidt et al. ..... 219/270
6,013,898 A 1/2000 Mizuno et al.
6,082,175 A * 7/2000 Yoshikawa et al. ..... 73/23.31
6,144,015 A * 11/2000 Chiu et al. ..... 219/270
6,177,653 B1 * 1/2001 Chiu et al. ..... 219/270
6,215,105 B1 * 4/2001 Simpkins et al. ..... 219/270
6,285,007 B1 * 9/2001 Chiu et al. ..... 219/270
6,326,595 B1 * 12/2001 Taniguchi et al. ..... 219/270
6,483,079 B1 * 11/2002 Sato et al. ..... 219/270

FOREIGN PATENT DOCUMENTS

EP 1139693 A2 10/2001 ..... H05B/3/14
JP 61-175415 8/1986
JP 62-91727 4/1987 ..... H05B/3/14
JP 10-208853 8/1998
JP 2003-056848 2/2003

* cited by examiner

*Primary Examiner*—Robin O. Evans
*Assistant Examiner*—Vinod Patel
(74) *Attorney, Agent, or Firm*—Kusner & Jaffe

(57) ABSTRACT

A glow plug includes a ceramic heater having a resistance-heating element embedded at its end portion. In order to supply electricity to the resistance-heating element, first and second heater terminals are exposed on the surface of the ceramic heater. First and second terminal rings, which serve as metallic fitting members, are shrink-fitted to the surface of the ceramic heater in such a manner as to cover and be electrically connected to the exposed first and second heater terminals. A metal layer not higher than Ni in ionization tendency is formed on the inner circumferential surface of each of the first and second terminal rings.

9 Claims, 11 Drawing Sheets

| | EXPERIMENTAL EXAMPLE A | EXPERIMENTAL EXAMPLE B | EXPERIMENTAL EXAMPLE C | EXPERIMENTAL EXAMPLE D | EXPERIMENTAL EXAMPLE E | EXPERIMENTAL EXAMPLE F |
|---|---|---|---|---|---|---|
| COVERED HEATER-TERMINAL AREA | 1.0S (S=s) | 1.0S (S=s) | 0.8S (S>s) | 0.5S (S>s) | 0.3S (S>s) | 0.2S (S>s) |
| |  |  |  |  |  |  |

* COVERED HEATER-TERMINAL AREA s DENOTES THE RATIO OF THE AREA OF CONTACT BETWEEN A EHATER TERMINAL AND A METAL LAYER TO THE AREA OF THE HEATER TERMINAL.

GLOW PLUG AND METHOD OF MANUFACTURING THE SAME

FIELD OF THE INVENTION

The present invention relates to a glow plug for preheating a diesel engine.

BACKGROUND OF THE INVENTION

Conventionally, a glow plug that has been widely used is configured such that a rodlike ceramic heater is disposed in a distal end portion of a tubular metallic shell with a distal end portion of the ceramic heater projecting from the distal end portion of the metallic shell. Current supplied to the ceramic heater flows along a route running through: a metallic rod disposed at a rear end portion of the metallic shell and connected to a power supply; a metallic lead element that connects the metallic rod and the ceramic heater; a first metallic fitting member; an electric conductor (including a conductive portion, a resistance-heating element, and a conductive portion) of the ceramic heater; a second metallic fitting member; the metallic shell; and an engine head. In a conventional glow plug, in order to suppress an increase in contact resistance, a ceramic heater and a metallic lead element are connected, for example, as follows: metal plating is performed on a portion of a conductive portion exposed from the ceramic heater (hereinafter, the portion may be referred to merely as an "exposed portion"), the conductive portion being connected to the resistance-heating element; and the ceramic heater is fitted into a metallic fitting member, to which the metallic lead element is connected, such that the exposed portion comes into contact with the metallic fitting member (see Japanese Patent Application Laid-Open (kokai) No. 61-175415).

According to a method for obtaining the above-mentioned plated exposed portion of the conductive portion, the conductive portion is first plated and is then embedded in the ceramic heater. However, this method involves a potential instability in electrical connection, since plating on the exposed portion is potentially scraped or exfoliated during a finish grinding process for the ceramic heater or a process of joining, for example, the ceramic heater and the metallic fitting members, or a ceramic heater assembly and the metallic shell. A conceivable method for avoiding this problem is to plate only the exposed portion of the conductive portion after embedment of the conductive portion. However, in order to perform such plating, the entire ceramic heater except the exposed portion is masked against plating and is then subjected to plating. Specifically, the entire ceramic heater is dipped in a plating solution. Studies conducted by the present inventors have revealed that such dipping in the plating solution damages ceramic, thereby impairing durability of the ceramic heater.

In some cases, the above-mentioned conductive portion of a ceramic heater contains W and/or Mo. Addition of such an element(s) imparts, to the conductive portion of the ceramic heater, appropriate resistance and a coefficient of thermal expansion near that of a ceramic substrate, which surrounds the conductive portion, so that the glow plug can have sufficiently high reliability. However, in the conductive portion that contains W and/or Mo, in some cases an oxide film may be formed on the surface of its exposed portion due to heat generated by the ceramic heater. As a result, even when the exposed portion of the conductive portion is plated with metal, contact resistance between the metallic fitting member and the exposed portion potentially increases.

SUMMARY OF THE INVENTION

An advantage of the present invention is a glow plug having ensured electrical connection and high reliability through suppressing an increase in contact resistance between an electric conductor and a metallic fitting member.

Another advantage of the present invention is a method of manufacturing a glow plug having ensured electrical connection and high reliability through suppressing an increase in contact resistance between an electric conductor and a metallic fitting member.

The present invention provides a glow plug comprising a ceramic heater assuming a rodlike form and having a resistance-heating element embedded in a distal end portion thereof; a first metallic fitting member externally joined to a rear end portion of the ceramic heater in such a manner as to surround an outer circumferential surface of the rear end portion; a second metallic fitting member disposed on a side toward a distal end of the ceramic heater in relation to the first metallic fitting member and externally joined to the ceramic heater in such a manner as to surround an outer circumferential surface of the ceramic heater; and a pair of electric conductors embedded in the ceramic heater so as to electrically connect the resistance-heating element and the first and second metallic fitting members. The electric conductors contain at least either W or Mo, one electric conductor has a first exposed portion joined to the first metallic fitting member, and the other electric conductor has a second exposed portion joined to the second metallic fitting member. In the glow plug, a metal layer not higher than Ni in ionization tendency is formed on an inner circumferential surface of the first metallic fitting member and on an inner circumferential surface of the second metallic fitting member, the inner circumferential surfaces facing the first and second exposed portions, respectively; and the metal layers are in contact with the corresponding first and second exposed portions such that an area of contact between the metal layer and the corresponding exposed portion is 30% or more of an area of the exposed portion.

The above-described glow plug of the present invention is characterized in that the metal layer not higher than Ni in ionization tendency is formed on the inner circumferential surface of each of the metallic fitting members. This feature smoothens the inner circumferential surfaces of the metallic fitting members, so that the metallic fitting members and the corresponding exposed portions of the electric conductors are mechanically joined together under such a smoothened surface condition. Therefore, electrical connection can be ensured at the joints between the metallic fitting members and the corresponding exposed portions. Since the metal layer is not higher than Ni in ionization tendency; i.e., has a sufficiently low reactivity with oxygen, oxidation of the exposed portions is prevented. In order to enhance the oxidation preventive effect, preferably, the metal layer is uniformly formed in an annular shape and is formed of a metal that does not react with high-temperature water vapor; i.e., is formed of a metal not higher than H in ionization tendency.

Furthermore, in the glow plug of the present invention, the metal layers and the corresponding exposed portions of the electric conductors are joined together such that an area of contact between the metal layer and the corresponding exposed portion is 30% or more of an area of the exposed portion. Thus, the metal layers and the corresponding exposed portions can be effectively joined together, and an increase in contact resistance can be suppressed, so that the glow plug can sufficiently exhibit required performance.

When the area of contact is less than 30% of the area of the exposed portion, a portion of the metal layer that is not engaged in contact with the exposed portion of each electric conductor is oxidized in the course of repeated use of the glow plug. The oxidation propagates to a portion of the metal layer in contact with the exposed portion of each electric conductor, causing an increase in contact resistance. As a result, conduction of electricity to the heater becomes unreliable, resulting in a failure to provide a glow plug with high reliability.

Preferably, in the glow plug of the present invention, the metal layer has a thickness of 0.2 $\mu$m to 10 $\mu$m.

In the glow plug of the present invention, impartment of a thickness of 0.2 $\mu$m to 10 $\mu$m to the metal layer effectively suppresses an increase in contact resistance. When the thickness is less than 0.2 $\mu$m, the suppressive effect is poorly attained. By contrast, even when a thickness in excess of 10 $\mu$m is imparted to the metal layer, the suppressive effect is not enhanced, but costs and time associated with manufacture increase. The thickness of the metal layer is more preferably 0.3 $\mu$m to 10 $\mu$m. A thickness of 0.2 $\mu$m raises no problem in terms of product reliability, but brings about a slight increase in contact resistance. A thickness of 0.3 $\mu$m allows provision of a product free from the problem.

In accordance with another aspect of the present invention, the present invention provides a method of manufacturing a glow plug which comprises a ceramic heater assuming a rodlike form and having a resistance-heating element embedded in a distal end portion thereof; a first metallic fitting member externally joined to a rear end portion of the ceramic heater in such a manner as to surround an outer circumferential surface of the rear end portion; a second metallic fitting member disposed on a side toward a distal end of the ceramic heater in relation to the first metallic fitting member and externally joined to the ceramic heater in such a manner as to surround an outer circumferential surface of the ceramic heater; a pair of electric conductors embedded in the ceramic heater so as to electrically connect the resistance-heating element and the first and second metallic fitting members. The electric conductors contain at least either W or Mo, one electric conductor has a first exposed portion joined to the first metallic fitting member, and the other electric conductor has a second exposed portion joined to the second metallic fitting member.

The method of manufacturing comprises the steps of forming a metal layer not higher than Ni in ionization tendency on an inner circumferential surface of the first metallic fitting member and on an inner circumferential surface of the second metallic fitting member, the inner circumferential surfaces facing the first and second exposed portions, respectively; and joining the first and second metallic fitting members to the ceramic heater such that the metal layers come into contact with the corresponding first and second exposed portions.

According to the method of manufacturing a glow plug of the present invention, the metal layer is formed on an inner circumferential surface of the first metallic fitting member and on an inner circumferential surface of the second metallic fitting member. Thus, the method does not involve potential damage to the exposed portions of the electric conductors during a finish grinding process for the ceramic heater or a process of joining the ceramic heater and the metallic fitting members, thereby preventing a potential instability in electrical connection.

When the metal layers and the corresponding exposed portions of the electric conductors are joined together such that the area of contact between the metal layer and the corresponding exposed portion is 30% or more of the area of the exposed portion, the above-mentioned damage preventive effect is more effectively yielded in the course of manufacture of glow plugs.

The metal layer may be formed on the metallic fitting members by any thin-film formation method, such as sputtering, plating, or vacuum deposition. Particularly, a plating method is preferred for forming the metal layer. The plating method can uniformly form the metal layer on the inner circumferential surfaces of the metallic fitting members. Such uniform formation of the metal layer provides the following effect. When the metallic fitting members are shrink-fitted to the ceramic heater, which has a circular cross section, no strain is generated in the metallic fitting members. Thus, even when thermal stresses are generated in the metallic fitting members, the thermal stresses are uniformly generated in the same direction. Therefore, the potential for cracking of the metallic fitting members and breakage of the glow plug can be reduced.

DESCRIPTION OF PREFERRED EMBODIMENT

An embodiment of the present invention will next be described in detail with reference to the drawings.

Figure 1:
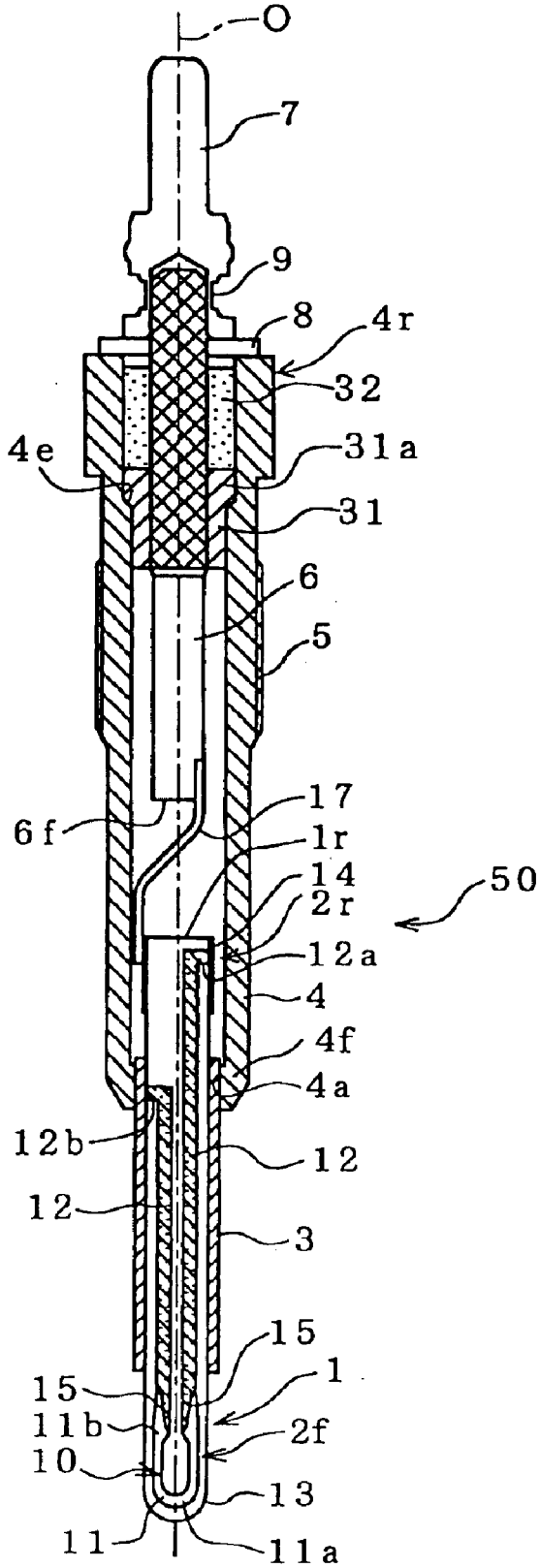
FIG. 1 is a vertical sectional view of a glow plug according to one embodiment of the present invention.
Figure 2:
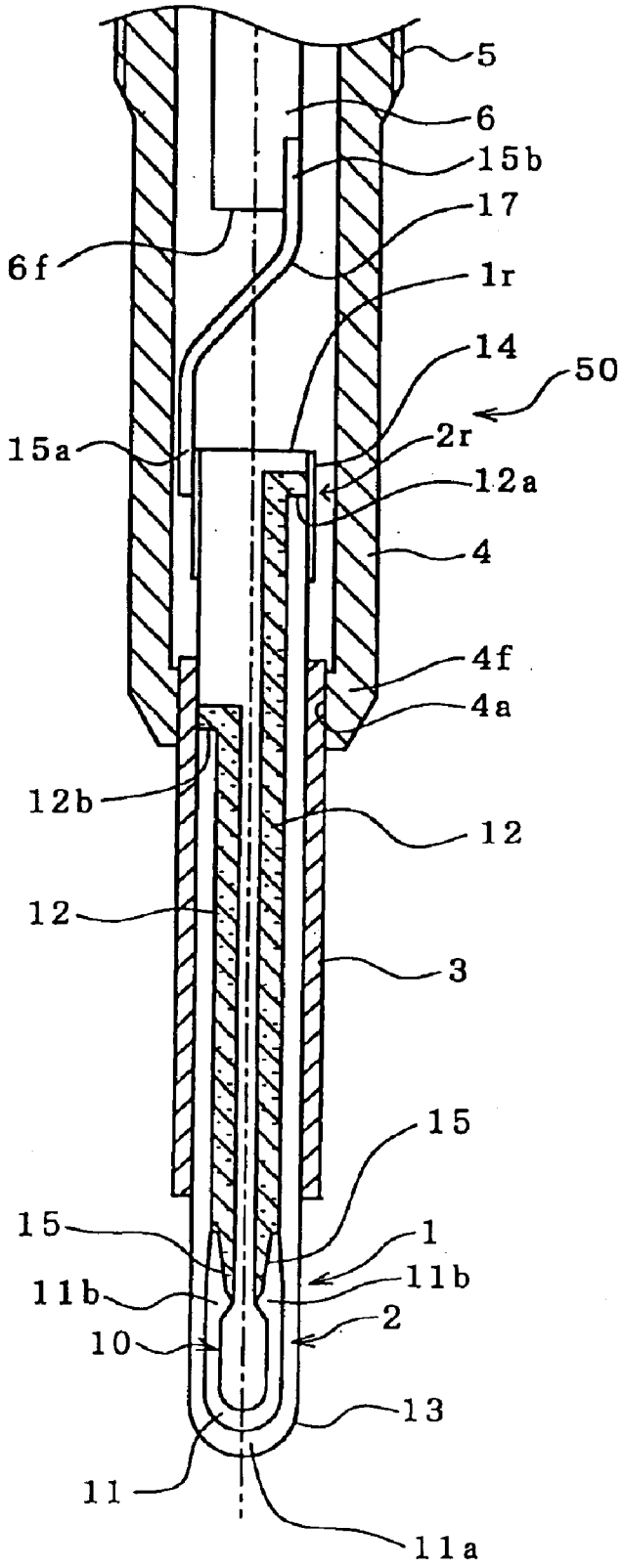
FIG. 2 is a vertical sectional view showing essential portions of FIG. 1.

FIG. 1 shows the internal structure of a glow plug 50 according to an embodiment of the present invention. FIG. 2 is an enlarged view of essential portions of the glow plug of FIG. 1. The glow plug 50 of FIG. 1 includes a ceramic heater 1 and a metallic shell 4, which holds the ceramic heater 1. The ceramic heater 1 assumes a rodlike form and has a resistance-heating element 11 embedded in a distal end portion 2*f* thereof. A first heater terminal (first exposed portion) 12*a* used to supply electricity to the resistance-heating element 11 is exposed at the outer circumferential surface of a rear end portion 2*r* of the ceramic heater 1. A second terminal ring (second metallic fitting member) 3 is formed into a tubular shape and holds the ceramic heater 1 therein such that the distal end and rear end portions 2*f* and 2*r* of the ceramic heater 1 project from the second terminal ring 3 in the direction of an axis O. The metallic shell 4 assumes a tubular shape and is coaxially joined to the second terminal ring 3.

The metallic shell 4 has a male-threaded portion 5 formed on the outer circumferential surface thereof. The male-threaded portion 5 serves as a mounting portion for mounting the glow plug 50 to an unillustrated engine block. A metallic rod 6 is attached to a rear end portion 4*r* of the metallic shell 4. The metallic rod 6 is inserted into the rear end portion 4*r* of the metallic shell 4 in the direction of the axis O and is disposed such that a distal end surface 6*f* thereof faces a rear end surface 1*r* of the ceramic heater 1 in the direction of the axis O. A first terminal ring (first metallic fitting member) 14 is electrically connected to the first heater terminal 12*a* and is shrink-fitted to the outer circumferential surface of the rear end portion 2*r* of the ceramic heater 1 in such a manner as to cover the first heater terminal 12*a*. The metallic rod 6 and the first heater terminal 12*a* are electrically connected by means of a metallic lead element 17, whose one end is joined to the first terminal ring 14 and whose other end is joined to the metallic rod 6.

A second heater terminal (second exposed portion) 12*b* used to supply electricity to the resistance-heating element 11 is exposed on the outer circumferential surface of the ceramic heater at a position located, in the direction of the axis O, on the side toward the distal end portion 2*f* of the ceramic heater 1 in relation to the first heater terminal 12*a*. The cylindrical, second terminal ring 3 is electrically connected to the second heater terminal 12*b* and is shrink-fitted to the outer circumferential surface of the ceramic heater 1 in such a manner as to cover the second heater terminal 12*b* and such that the rear end portion 2*r* of the ceramic heater 1 projects rearward therefrom. The metallic shell 4 is attached to the outer circumferential surface of the second terminal ring 3 via its cylindrical heater-holding surface 4*a*.

Figure 8:
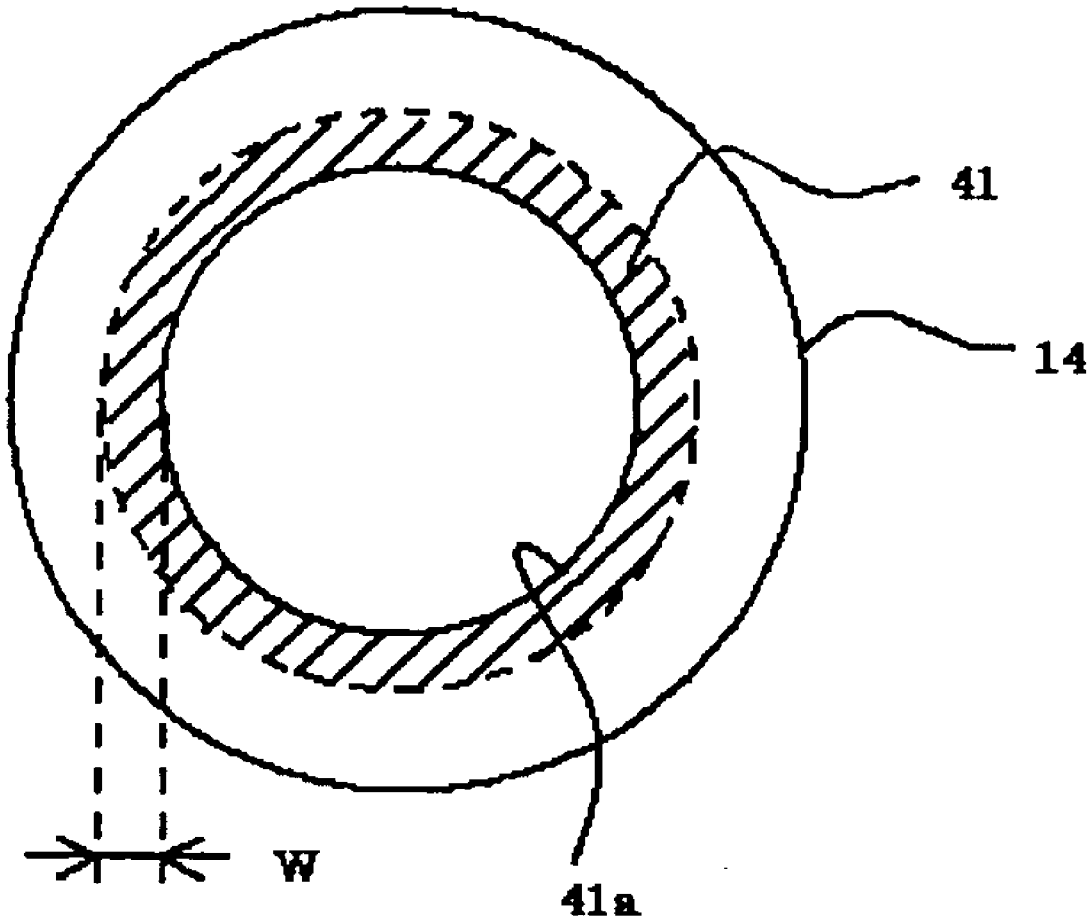
FIG. 8 is a view showing a coating layer of metal formed in an internal circumferential surface region of the first terminal ring.

In the present invention, in each of the first and second terminal rings 14 and 3, which serve as metallic fitting members, an inner surface layer portion assumes the form of a metal layer 41 made of a metal; for example, Cu, not higher than Ni in ionization tendency. FIG. 8 shows a cross section of the first terminal ring 14, which serves as a metallic fitting member. As shown in FIG. 8, the metal layer 41 having a thickness w ($\mu$m) is formed toward the interior of the first terminal ring 14 from an inner circumferential surface 41*a*. The thickness w of the metal layer 41 is 0.2 $\mu$m to 10 $\mu$m. A metal layer having such thickness can be favorably formed by means of, for example, sputtering, plating, or vacuum deposition. That is, no limitations are imposed on a method for forming the metal layer 41, so long as the metal layer 41 not higher than Ni in ionization tendency is formed at inner circumferential surfaces of the first and second terminal rings 14 and 3, which face the first and second heater terminals 12*a* and 12*b*, respectively, in the course of manufacturing a glow plug through employment of shrink fit between the ceramic heater 1 and the first and second terminal rings 14 and 3.

The metal layer 41 may assume the form of a single layer or a plurality of layers. For example, when a metal layer having poor adhesion to a metallic fitting member is to be formed, the metal layer may be formed as follows. First, a primary metal layer having relatively good adhesion to the metal fitting member is formed. Then, a metal layer of a desired component is formed on the primary metal layer. For example, a particularly effective metal layer is formed as follows: a thin Ni strike plating layer is formed on the inner circumferential surface of a metallic fitting member, and then a Cu plating layer is formed on the Ni strike plating layer. According to the present embodiment, the metal layer 41 is formed on the inner circumferential surfaces of the first and second terminal rings 14 and 3 by electroplating. However, a metal layer may be formed on the ceramic heater side by electroless plating, sputtering, vapor deposition, printing, or CVD, which are well-known thin-film formation processes.

Formation of the metal layer 41 suppresses, to 10 mΩ or less, the contact resistance that arises as a result of fitting the first and second terminal rings 14 and 3, which serve as metallic fitting members, to the ceramic heater 1; i.e., the contact resistance between the first and second terminal rings 14 and 3 and the first and second heater terminals 12*a* and 12*b*, respectively. Such reduction of contact resistance suppresses generation of heat at joints between the ceramic heater 1 and the first and second terminal rings 14 and 3, thereby suppressing a drop in tightening force in the course of use.

Figure 7A:
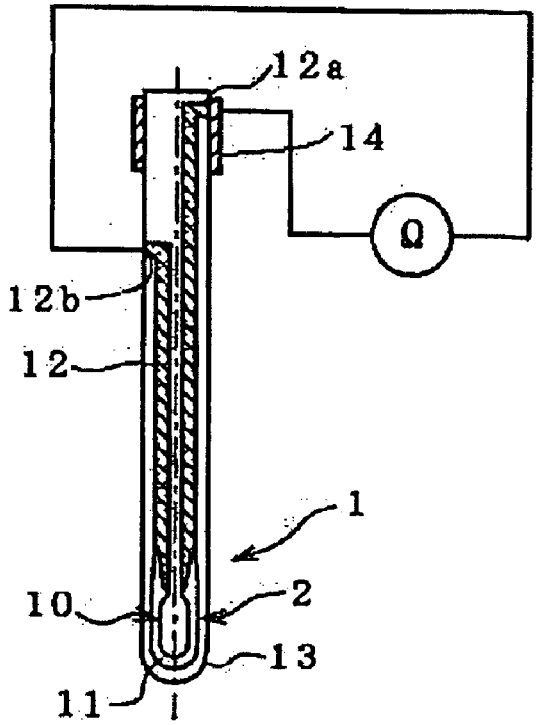
FIGS. 7A and 7B are views for explaining a method of measuring contact resistance.
Figure 7B:
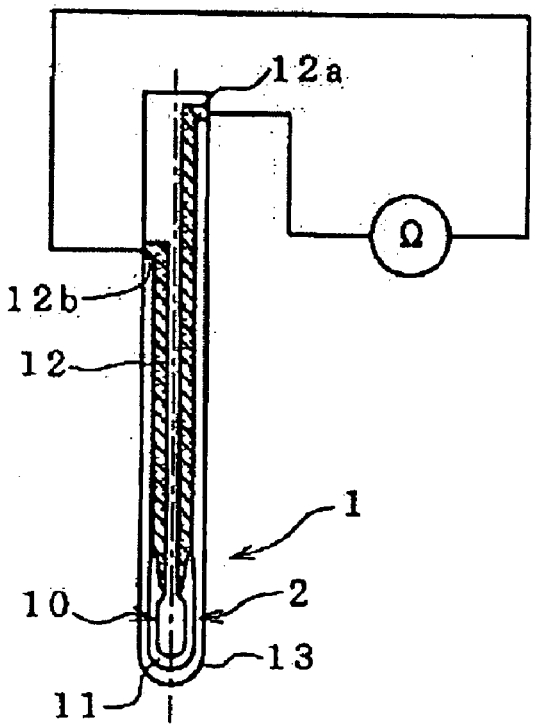

In the case of the first terminal ring 14 serving as a metallic fitting member, the above-mentioned contact resistance is measured, for example, as follows. First, as shown in FIG. 7A, the ceramic heater 1 is removed from the glow plug 50 while the first terminal ring 14 is held attached to the same. At this time, the first heater terminal 12*a* and the first terminal ring 14 are in an electrically connected condition. Next, current is applied between the first terminal ring 14 and the second heater terminal 12*b* to measure resistance. The thus-measured resistance is taken as a resistance-before-disassembly R1 (Ω). Next, as shown in FIG. 7B, the attached first terminal ring 14 is removed from the ceramic heater 1 to bring the ceramic heater 1 in a disassembled condition. Resistance is measured between the first heater terminal 12*a* exposed on the outer circumferential surface of the ceramic heater 1 and the second heater terminal 12*b*. The thus-measured resistance is taken as a resistance-after-disassembly R2 (Ω). The contact resistance between the first terminal ring 14, which serves as a metallic fitting member, and the first heater terminal 12*a* is represented as R1−R2 (Ω). Contact resistance in relation to the second terminal ring 3 can also be measured by a similar method. Notably, contact resistance appearing in the present specification may be determined as follows: while the first and second terminal rings 14 and 3 are fitted to the ceramic heater 1, current is applied between the first terminal ring 14 and the second terminal ring 3 to measure resistance therebetween; the thus-measured resistance is taken as the resistance-before-disassembly R1; on the basis of the thus-obtained resistance-before-disassembly R1, contact resistance stemming from the first terminal ring 14 and the second terminal ring 3 is obtained; and the thus-obtained contact resistance is taken as the contact resistance appearing in the present specification. The thus-defined contact resistance may be set so as to satisfy the relation $(R1-R2)/R2\times100\leqq20$ (%).

Next, the metallic shell 4 and the second terminal ring 3 may be joined together, for example, as follows: brazing is performed in such a manner as to fill the clearance between the inner circumferential surface of the metallic shell 4 and the outer circumferential surface of the second terminal ring 3, or the opening edge of a distal end 4*f* of the metallic shell 4 and the outer circumferential surface of the second terminal ring 3 are laser-welded along the entire circumference. In the present embodiment, the metallic shell 4 is shrink-fitted to the outer circumferential surface of the second terminal ring 3 via its heater-holding surface 4*a*. Employment of such shrink fit simplifies an assembling process for the glow plug 50. Needless to say, the above-mentioned methods may be combined such that brazing is performed before press fitting.

This will increase joining strength. A surface of fit (heater-holding surface 4*a*) of the metallic shell 4 which surface of fit is fitted to the second terminal ring 3 coincides, in a position along the direction of the axis O, with a surface of fit between the second terminal ring 3 and the ceramic heater 1. Thus, a tightening force that the metallic shell 4 imposes on the second terminal ring 3 is superposed on a tightening force that the second terminal ring 3 imposes on the ceramic heater 1, thereby enhancing gastightness that is established by fitting the ceramic heater 1 into the second terminal ring 3.

Figure 4:
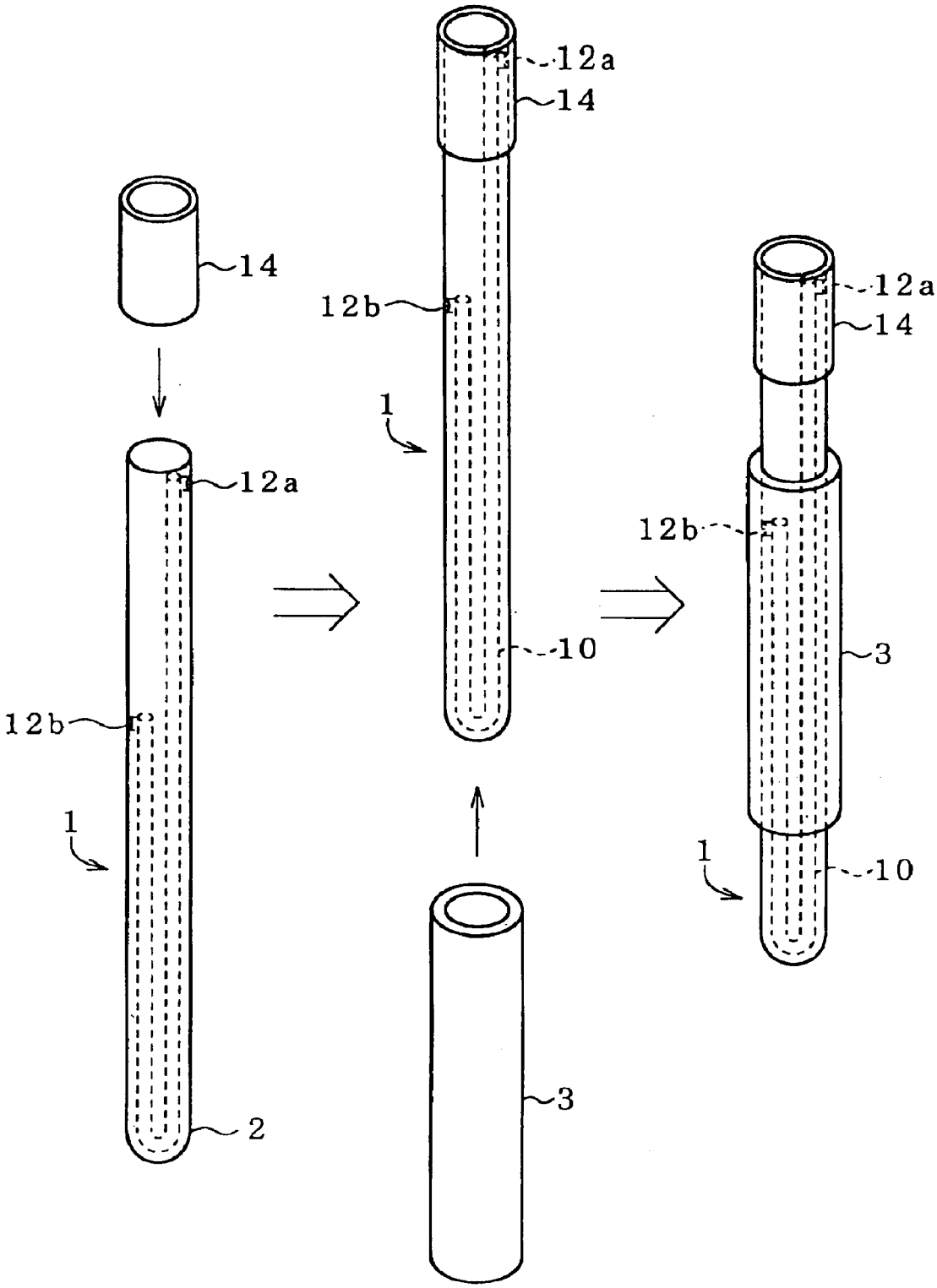
FIG. 4 is an explanatory view continued from FIG. 3.
Figure 5:
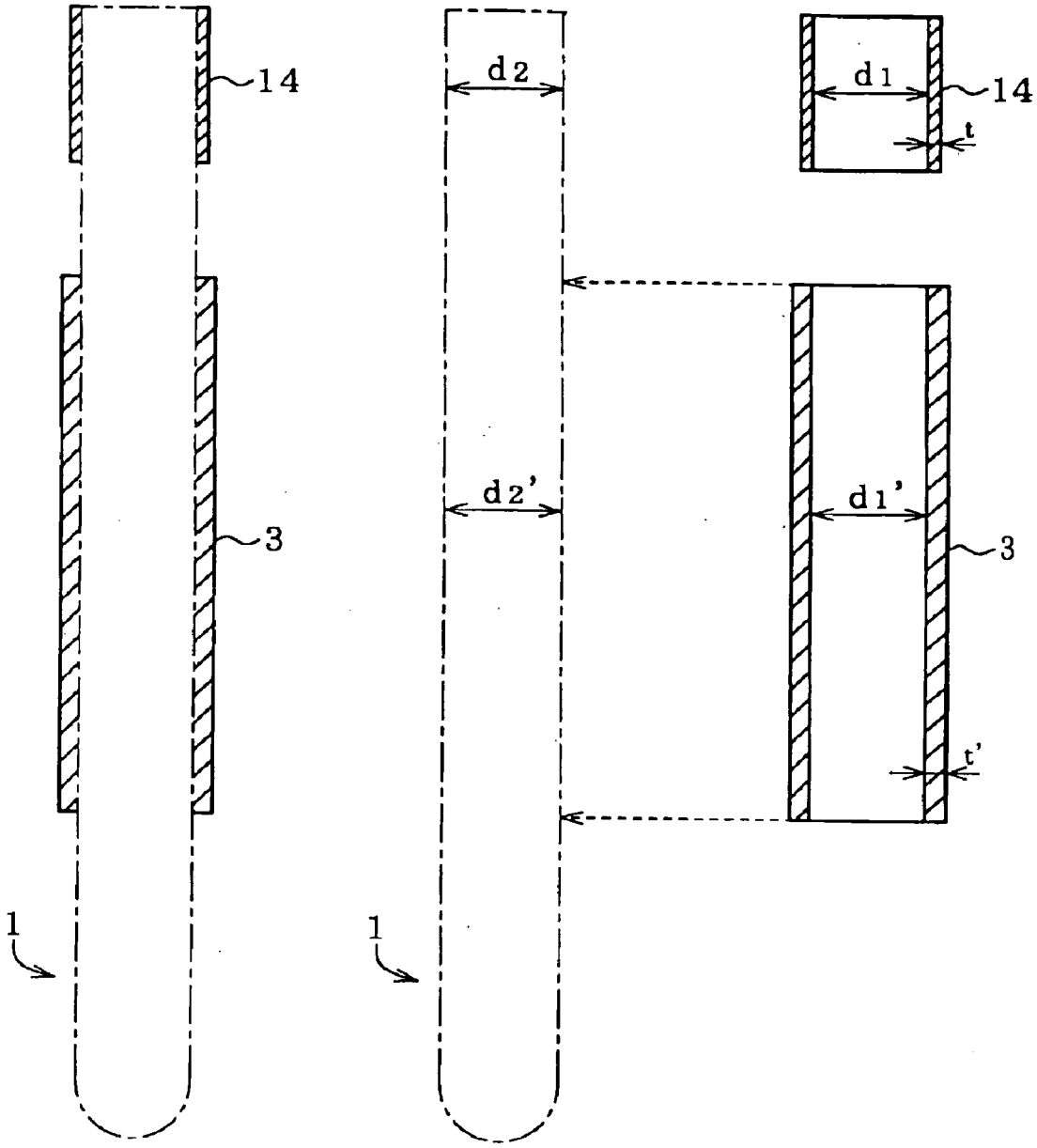
FIG. 5 is a view for explaining regions of a ceramic heater and regions of first and second terminal rings for use in calculating interferences of shrink fit after disassembly.

The first and second terminal rings 14 and 3 can be attached to the ceramic heater 1, for example, as shown in FIG. 4. Specifically, each of the first and second terminals rings 14 and 3 is fitted to an end portion of the ceramic heater 1 and is then pressed in the axial direction to thereby be press-fitted to the ceramic heater 1. In place of press fit, shrink fit may be employed. The first terminal ring 14 is expected to generate such a tightening force as to ensure electrical connection between the same and the first heater terminal 12*a*. In the case of the second terminal ring 3, in addition to secure establishment of electrical connection between the same and the second heater terminal 12*b*, gastightness must be securely established along the surface of fit between the same and the ceramic heater 1. Thus, the second terminal ring 3 must generate a tightening force greater than that generated by the first terminal ring 14. In either case of the first terminal ring 14 and the second terminal ring 3, a necessary and sufficient tightening force must be secured not only at the room temperature but also at an increased temperature of the ceramic heater 1, an increase in temperature involving thermal expansion of components. Generally, in comparison between ceramic and metal, except for special alloys such as Invar, metal is higher in coefficient of linear expansion; thus, when temperature rises, tightening forces generated by the first and second terminal rings 14 and 3 tend to weaken.

As shown in FIG. 2, the metallic lead element 17 is curved and disposed between the metallic rod 6 and the first terminal ring 14. Thus, when the metallic lead element 17 is subjected to heating/cooling cycles induced by heat generation of the ceramic heater 1, its curved portions can absorb its expansion/contraction, thereby preventing occurrence of problems, such as poor contact and breaking of wire, which could otherwise result from excessive stress concentration on a joint portion between the metallic lead element 17 and the first terminal ring 14. In order to readily and strongly join the metallic lead element 17 and the metallic rod 6 together, a joining end portion of the metallic lead element 17 assumes a planar shape and is joined to a planar recess formed on the outer circumferential surface of a distal end portion of the metallic rod 6. For example, when the metallic lead element 17 and the metallic rod 6 are to be resistance-welded together, employment of such a planar joint surface allows uniform application of welding pressure during resistance welding and is thus advantageous for forming a weld joint with few defects.

Preferably, the metallic lead element 17 and the first terminal ring 14 are joined as follows. In order to avoid interference with a process of attaching the first terminal ring 14 to the ceramic heater 1 by means of, for example, press fit, the first terminal ring 14 is first attached to the ceramic heater 1. Then, an end portion of the metallic lead element 17 is joined to, for example, the outer circumferential surface of the attached first terminal ring 14. In this case, joining can be performed by means of resistance welding or brazing.

The ceramic heater 1 assumes the form of a rodlike ceramic heater configured such that the resistance-heating element 11 is embedded in a ceramic substrate 13 formed of an insulative ceramic. In the present embodiment, the ceramic heater 1 is configured such that a ceramic resistor 10 formed of a conductive ceramic is embedded in the ceramic substrate 13 formed of insulative ceramic. The ceramic resistor 10 includes a first resistor portion 11 and a pair of second resistor portions 12. The first resistor portion 11 is disposed at the distal end portion 2*f* of the ceramic heater 1; is formed of a first conductive ceramic; and functions as a resistance-heating element. The paired second resistor portions 12 are disposed in such a manner as to extend rearward from the first resistor portion 11 in the direction of the axis O of the ceramic heater 1. Distal end portions of the second resistor portions 12 are joined to corresponding opposite end portions of the first resistor portion 11, the opposite end portions being end portions along the flow of current. The second resistor portions 12 are formed of a second conductive ceramic, whose resistivity is lower than that of the first conductive ceramic, and serve as conductive portions. The paired second resistor portions 12 of the ceramic resistor 10 have respective divergence portions formed at different positions along the direction of the axis O. The divergence portions are exposed at the surface of the ceramic heater 1, thereby forming the first heater terminal 12*a* and the second heater terminal 12*b*.

Figure 6:
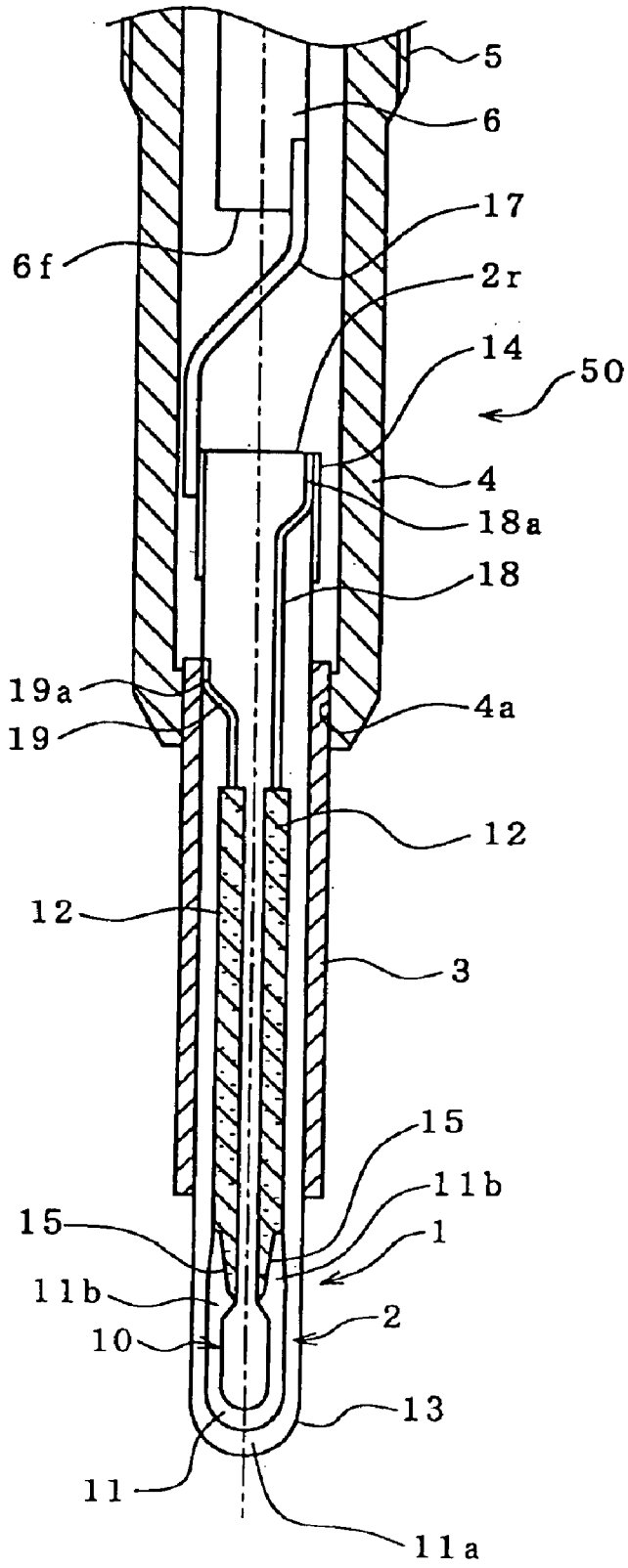
FIG. 6 is a vertical sectional view showing essential portions of a first modification of the glow plug of FIG. 1.

Meanwhile, electricity can also be supplied to the resistance-heating element 11, for example, as shown in FIG. 6, via lead wires 18 and 19, which are embedded in the ceramic substrate 13 and which are formed of a high-melting-point metal, such as an alloy that contains at least either W or Mo. In this case, an exposed portion 18*a* of the embedded lead wire 18 serves as a first heater terminal, and an exposed portion 19*a* of the embedded lead wire 19 serves as a second heater terminal. Even in this case, the contact resistance between the first terminal ring 14 and the ceramic heater 1 and that between the second terminal ring 3 and the ceramic heater 1 fall within the range of the present invention.

Next, the present embodiment employs silicon nitride ceramic as an insulative ceramic used to form the ceramic substrate 13. Silicon nitride ceramic assumes a microstructure such that main-phase grains, which contain a predominant amount of silicon nitride ($Si_3N_4$), are bonded by means of a grain boundary phase derived from, for example, a sintering aid component, which will be described later. The main phase may be such that a portion of Si or N atoms are substituted by Al or O atoms, and may contain metallic atoms, such as Li, Ca, Mg, and Y, in the form of solid solution.

Silicon nitride ceramic can contain, as a cation element, at least one element selected from the group consisting of Mg and elements belonging to Groups 3A, 4A, 5A, 3B (e.g., Al), and 4B (e.g., Si) of the Periodic Table, in an amount of 1% to 10% by mass as reduced to an oxide thereof and as measured in an entire sintered body. These components are added mainly in the form of oxides and are present in a sintered body mainly in the form of oxides or composite oxides, such as silicate. When the sintering aid component content is less than 1% by mass, an obtained sintered body is unlikely to become dense. When the sintering aid component content is in excess of 10% by mass, strength, toughness, or heat resistance becomes insufficient. Preferably, the sintering aid component content is 2% to 8% by mass. Rare-earth components that can be used as sintering aid components are Sc, Y, La, Ce, Pr, Nd, Sm, Eu, Gd, Tb, Dy, Ho, Er, Tm, Yb, and Lu. Particularly, Tb, Dy, Ho, Er, Tm, and Yb can be used favorably, since they have the effect of promoting crystallization of the grain boundary phase and improving high-temperature strength.

Next, as mentioned previously, the first resistor portion 11 and the second resistor portions 12, which constitute the ceramic resistor 10, are formed of conductive ceramics of different electrical resistivities. No particular limitations are imposed on a method for differentiating the two conductive ceramics in electrical resistivity. Example methods include:

a: a method in which the same conductive ceramic phase is used, but its content is rendered different;

b: a method in which conductive ceramic phases of different electrical resistivities are employed; and c: a method in which a and b are combined.

The present embodiment employs method a.

A conductive ceramic phase can be of a known substance, such as tungsten carbide (WC), molybdenum disilicide ($MoSi_2$), or tungsten disilicide ($WSi_2$). The present embodiment employs WC. In order to enhance thermal-shock resistance through reduction of the difference in linear expansion coefficient between a resistor portion and the ceramic substrate 13, an insulative ceramic phase serving as a main component of the ceramic substrate 13; i.e., a silicon nitride ceramic phase used herein, can be mixed with the conductive ceramic phase. By changing the content ratio between the insulative ceramic phase and the conductive ceramic phase, the conductive ceramic used to form the resistor portion can be adjusted in electrical resistivity to a desired value.

Specifically, the first conductive ceramic used to form the first resistor portion 11 serving as a resistance-heating portion may contain a conductive ceramic phase in an amount of 10% to 25% by volume and an insulative ceramic phase as balance. When the conductive ceramic phase content is in excess of 25% by volume, conductivity becomes too high, resulting in a failure to provide a sufficient heating value. When the conductive ceramic phase content is less than 10% by volume, conductivity becomes too low, also resulting in a failure to provide a sufficient heating value.

The second resistor portions 12 serve as electricity conduction paths to the first resistor portion 11. The second conductive ceramic used to form the second resistor portions 12 may contain a conductive ceramic phase in an amount of 15% to 30% by volume and an insulating ceramic phase as balance. When the conductive ceramic phase content is in excess of 30% by volume, densification through firing becomes difficult to achieve, with a resultant tendency toward insufficient strength; additionally, an increase in electrical resistivity becomes insufficient even when a temperature region which is usually used for preheating an engine is reached, potentially resulting in a failure to yield a self-saturation function for stabilizing current density. When the conductive ceramic phase content is less than 15% by volume, heat generation of the second resistor portions 12 becomes excessive, with a resultant impairment in heat generation efficiency of the first resistor portion 11. In the present embodiment, the WC content of the first conductive ceramic is 16% by volume (55% by mass), and the WC content of the second conductive ceramic is 20% by volume (70% by mass) (both ceramics contain silicon nitride ceramic (including a sintering aid) as balance).

In the present embodiment, the ceramic resistor 10 is configured as follows. The first resistor portion 11 assumes the shape resembling the letter U, and a bottom portion of the U shape is positioned in the vicinity of the distal end 2*f* of the ceramic heater 1. The second resistor portions 12 assume a rodlike shape and extend rearward along the direction of the axis O substantially in parallel with each other from the corresponding end portions of the U-shaped first resistor portion 11.

In the ceramic resistor 10, in order to cause current to intensively flow to a distal end portion 11*a* of the first resistor portion 11, which distal end portion 11*a* must assume the highest temperature during operation, the first resistor portion 11 is configured such that the distal end portion 11*a* has a diameter smaller than that of opposite end portions 11*b*. A joint interface 15 between the first resistor portion 11 and each of the second resistor portions 12 is formed at each of the opposite end portions 11*b*, whose diameter is greater than that of the distal end portion 11*a*.

As shown in FIG. 6, in the case of a structure in which the metallic lead wires 18 and 19 are embedded in ceramic, when heater drive voltage is applied at high temperature, the metallic lead wires 18 and 19 wear down because of the so-called electromigration effect, in which atoms of metal used to form the metallic lead wires 18 and 19 are forcibly diffused toward ceramic upon subjection to an electrochemical drive force induced by an electric field gradient associated with voltage application, resulting in a likelihood of breaking of the metallic lead wires 18 and 19 or a like problem. By contrast, the structure of FIG. 2 does not employ embedded lead wires and thus is intrinsically not prone to the above-described electromigration.

Next, as shown in FIG. 1, the metallic rod 6 for supplying electricity to the ceramic heater 1 is disposed within the rear end portion 4*r* of the metallic shell 4 while being electrically insulated from the metallic shell 4. In the present embodiment, a ceramic ring 31 is disposed between the outer circumferential surface of a rear portion of the metallic rod 6 and the inner circumferential surface of the metallic shell 4, and a glass filler layer 32 is formed on the rear side of the ceramic ring 31 to thereby fix the metallic rod 6 in place. A ring-side engagement portion 31*a*, which assumes the form of a large-diameter portion, is formed on the outer circumferential surface of the ceramic ring 31. A shell-side engagement portion 4*e*, which assumes the form of a circumferentially extending stepped portion, is formed on the inner circumferential surface of the metallic shell 4 at a position biased toward the rear end of the metallic shell 4. The ring-side engagement portion 31*a* is engaged with the shell-side engagement portion 4*e* to thereby prevent the ceramic ring 31 from slipping axially forward. An outer circumferential surface of the metallic rod 6 in contact with the glass filler layer 32 is knurled by knurling or a like process (in FIG. 1, the hatched region). A rear end portion of the metallic rod 6 projects rearward from the metallic shell 4, and a metallic terminal member 7 is fitted to the projecting portion of the metallic rod 6 via an insulating bush 8. The metallic terminal member 7 is fixedly attached to the outer circumferential surface of the metallic rod 6 in an electrically continuous condition by a circumferentially crimped portion 9.

The glow plug 50 is mounted to a diesel engine by means of the male-threaded portion 5 of the metallic shell 4 such that the distal end portion 2*f* of the ceramic heater 1 is positioned within a combustion chamber. Connection of the metallic terminal member 7 to a power supply causes current to flow along the following route: metallic rod 6→metallic lead element 17→first terminal ring 14→ceramic heater 1→second terminal ring 3→metallic shell 4→(grounded via an engine block). As a result, the distal end portion 2*f* of the ceramic heater 1 generates heat, thereby preheating the interior of the combustion chamber.

A method for manufacturing the glow plug 50 will next be described.

Figure 3A:
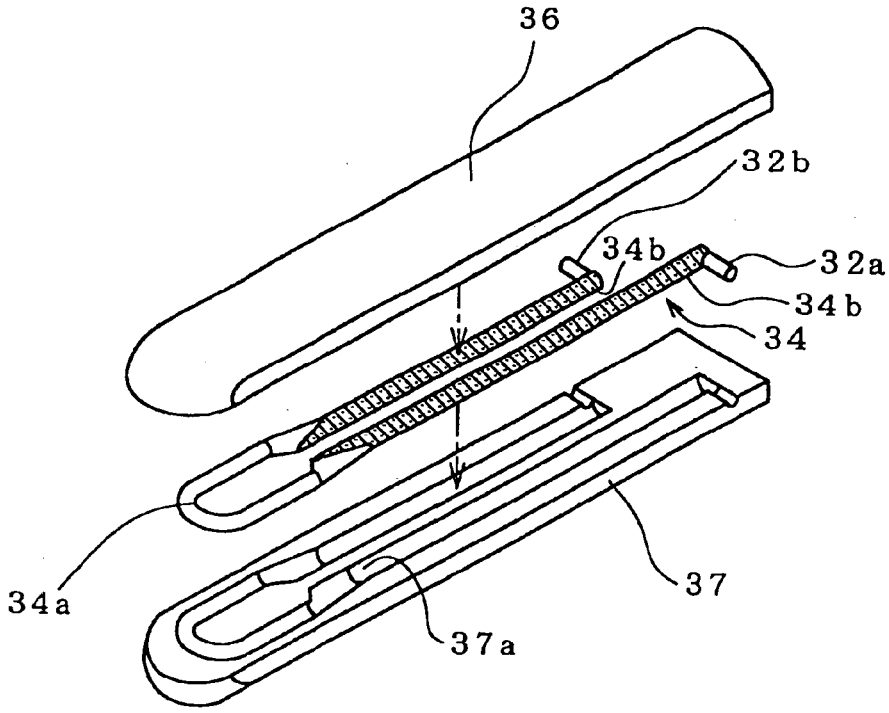
FIGS. 3A and 3B are views for explaining steps of manufacturing the glow plug of FIG. 1.
Figure 3B:
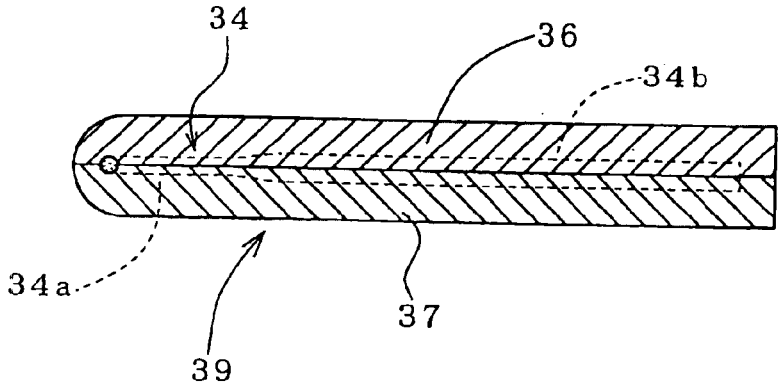

First, as shown in FIG. 3, a resistor green body 34, which is to become the ceramic resistor 10, is formed by injection molding. A material powder for forming the ceramic substrate 13 is die-pressed beforehand into half green bodies 36 and 37, which are upper and lower substrate green bodies formed separately. A recess 37*a* (a recess formed on the half green body 36 is unseen on FIG. 3A) having a shape corresponding to the resistor green body 34 is formed on the mating surface of each of the half green bodies 36 and 37. Next, the half green bodies 36 and 37 are joined together at the above-mentioned mating surfaces, while the resistor green body 34 is accommodated in the recesses. The thus-obtained assembly of the half green bodies 36 and 37 and the resistor green body 34 is compressed by use of a press, thereby obtaining a composite green body 39 as shown in FIG. 3B.

The thus-obtained composite green body 39 is debindered and is then fired at a temperature equal to or higher than 1,700° C.; e.g., about 1,800° C., by, for example, hot pressing, to thereby be formed into a fired body. The surface of the fired body is polished into a cylindrical shape, whereby the ceramic heater 1 is obtained. Then, as shown in FIG. 4, the first terminal ring 14 and the second terminal ring 3, whose inner circumferential surfaces have been plated beforehand with a metal (e.g., Cu) not higher than Ni in ionization tendency, are shrink-fitted to the ceramic heater 1 by, for example, press fitting. Furthermore, necessary components, such as the metallic lead element 17 and the metallic shell 4, are attached, thereby completing the glow plug 50 shown in FIG. 1. In the above-mentioned plating process, a metal layer may be formed on portions of the inner circumferential surfaces of the first and second terminal rings 14 and 3 which portions face the corresponding first and second heater terminals 12*a* and 12*b*, in such a manner that the metal layers come into contact with the corresponding first and second heater terminals 12*a* and 12*b*. However, in actuality, as shown in FIG. 8, the plating process can be performed readily and effectively by performing plating on the entire inner circumferential surface or on the entire inner and outer circumferential surfaces.

EXAMPLES

In order to confirm the effects of the present invention, the following experiments were performed.

Figure 9A:
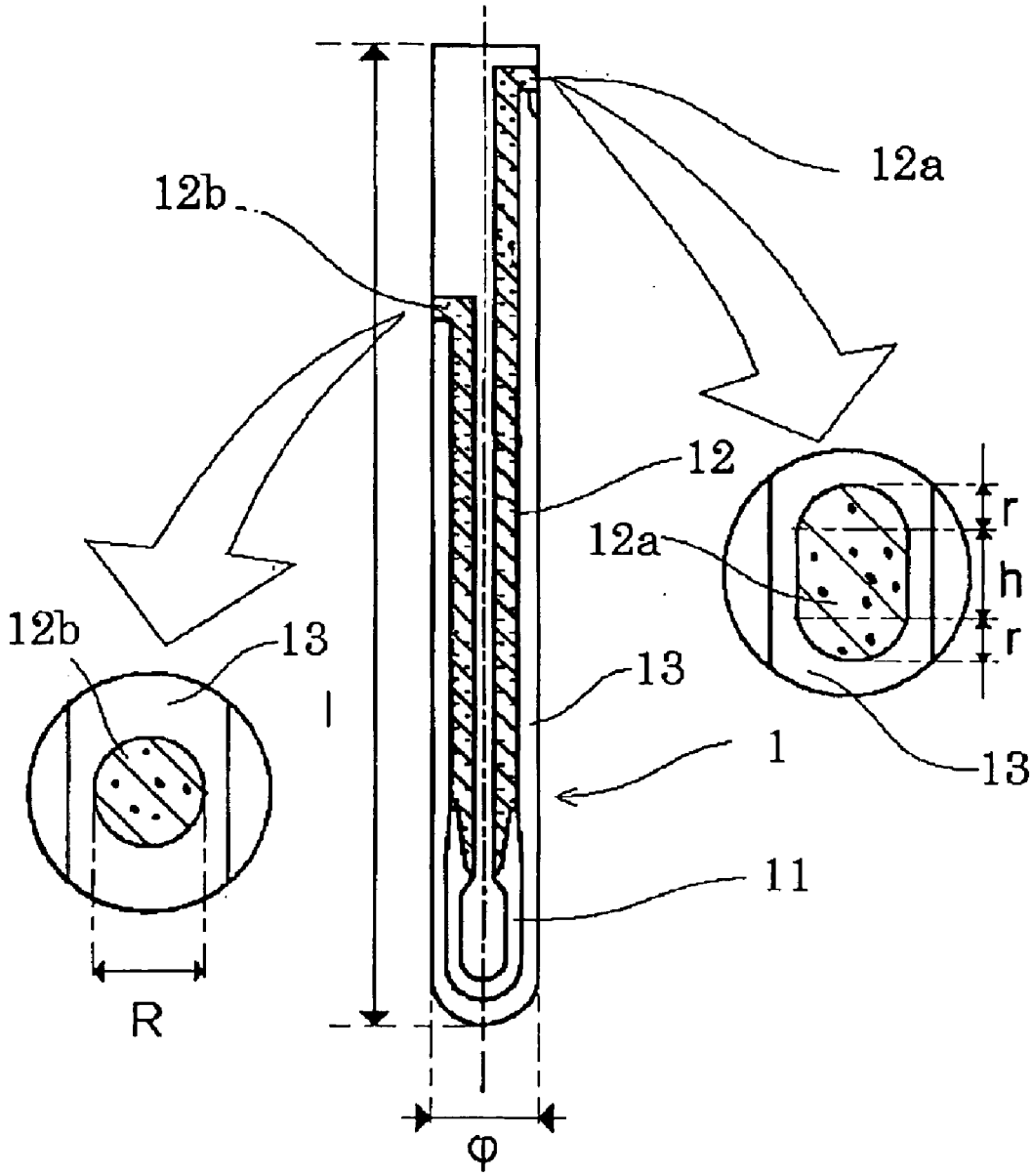
FIG. 9A is a view showing dimensional details of a glow plug used in experiments.

First, the ceramic heaters 1 shown in FIG. 1 were fabricated by the above-described method. For the sake of convenience, the following description discusses a single ceramic heater 1 as needed. The ceramic heater 1 had a length 1 of 40 mm and an outside diameter ϕ of 3.5 mm; each of the second resistor portions 12 had a thickness of 1 mm; the first heater terminal 12*a* assumed the form of a region (in a shape resembling to, for example, an athletics track) defined by two parallel line segments (2.0 mm) extending along the direction of the axis O, an arc r (radius r=0.4 mm) connecting the distal end points of the line segments, and an arc r (radius r=0.4 mm) connecting the rear end points of the line segments; and the second heater terminal 12*b* assumed the form of a circular region having a diameter R of 0.8 mm. All of the ceramic heaters 1 appearing in Examples described below assume the above features. Dimensional definitions are shown in FIG. 9A.

Experimental Example 1

The first and second terminal rings 14 and 3 were fabricated by use of SUS630. The first terminal rings 14 had the following dimensions: thickness: 0.25 mm; axial length: 0.5 mm to 6 mm (Experimental Example A: 6.0 mm; Experimental Example B: 2.8 mm; Experimental Example C: 2.2 mm; Experimental Example D: 1.3 mm; Experimental Example E: 0.8 mm; and Experimental Example F: 0.5 mm); and inside diameter d1: 3.4 mm. The second terminal rings 3 had the following dimensions: thickness: 0.85 mm; axial length: 20 mm; and inside diameter d1: 3.4 mm. An Ni strike plating layer was formed on the inner circumferential surfaces of the first and second terminal rings 14 and 3, which are to be fitted to the ceramic heater 1, by use of a known chloride bath. Subsequently, a Cu plating layer was formed on the Ni strike plating layer by use of a sulfate bath, thereby forming the metal layer 41 having a thickness of 3.2 μm.

The thus-fabricated second terminal ring 3 was fixed by use of a jig and was then attached to the ceramic heater 1 at a predetermined position through press fitting. As shown in FIG. 4, when the second terminal ring 3 is fitted to the ceramic heater 1 at the predetermined position, the metal layer plated on the inner circumferential surface of the second terminal ring 3 is in complete contact with the second heater terminal 12*b*.

Figure 9B:
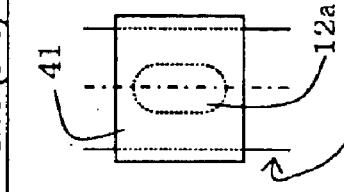
FIG. 9B is a view showing the contact ratios between a first heater terminal and a metal layer with respect to Experimental Examples.
Figure 9B:
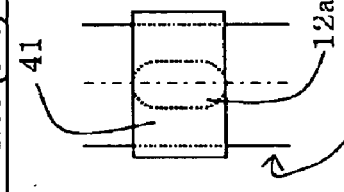
Figure 9B:
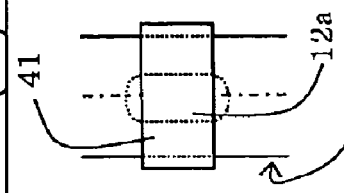
Figure 9B:
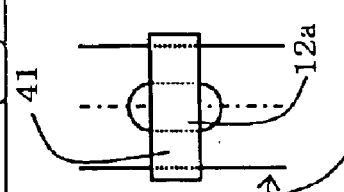
Figure 9B:
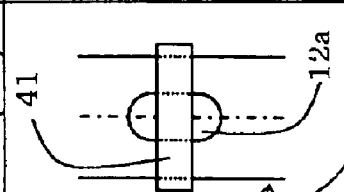
Figure 9B:
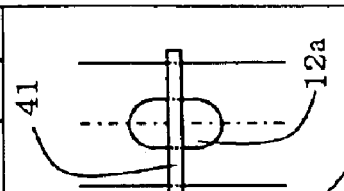

Similarly, the first terminal ring 14 was fixed by use of a jig and was then attached to the ceramic heater 1 through press fitting. When S represents the surface area of the first heater terminal 12*a* of the ceramic heater 1, and s represents the area of a portion of the metal layer 41 formed on the inner circumferential surface of the first terminal ring 14 (not shown) which portion is in contact with the first heater terminal 12*a*, the prepared first terminal rings 14 were, as shown in FIG. 9B, as follows: Experimental Examples A and B: S=s; Experimental Example C: S>s (=0.8S); Experimental Example D: S>s (=0.5S); Experimental Example E: S>s (=0.3S); and Experimental Example F: S>s (=0.2S). Notably, in the press fitting process, lubricant (PASKIN M30 (trade name, product of KYOEISHA CHEMICAL Co., LTD) was applied in an appropriate amount to the inner circumferential surfaces of the first terminal rings 14. After press fitting, the applied lubricant was decomposed at a temperature of 300° C.

Figure 10:
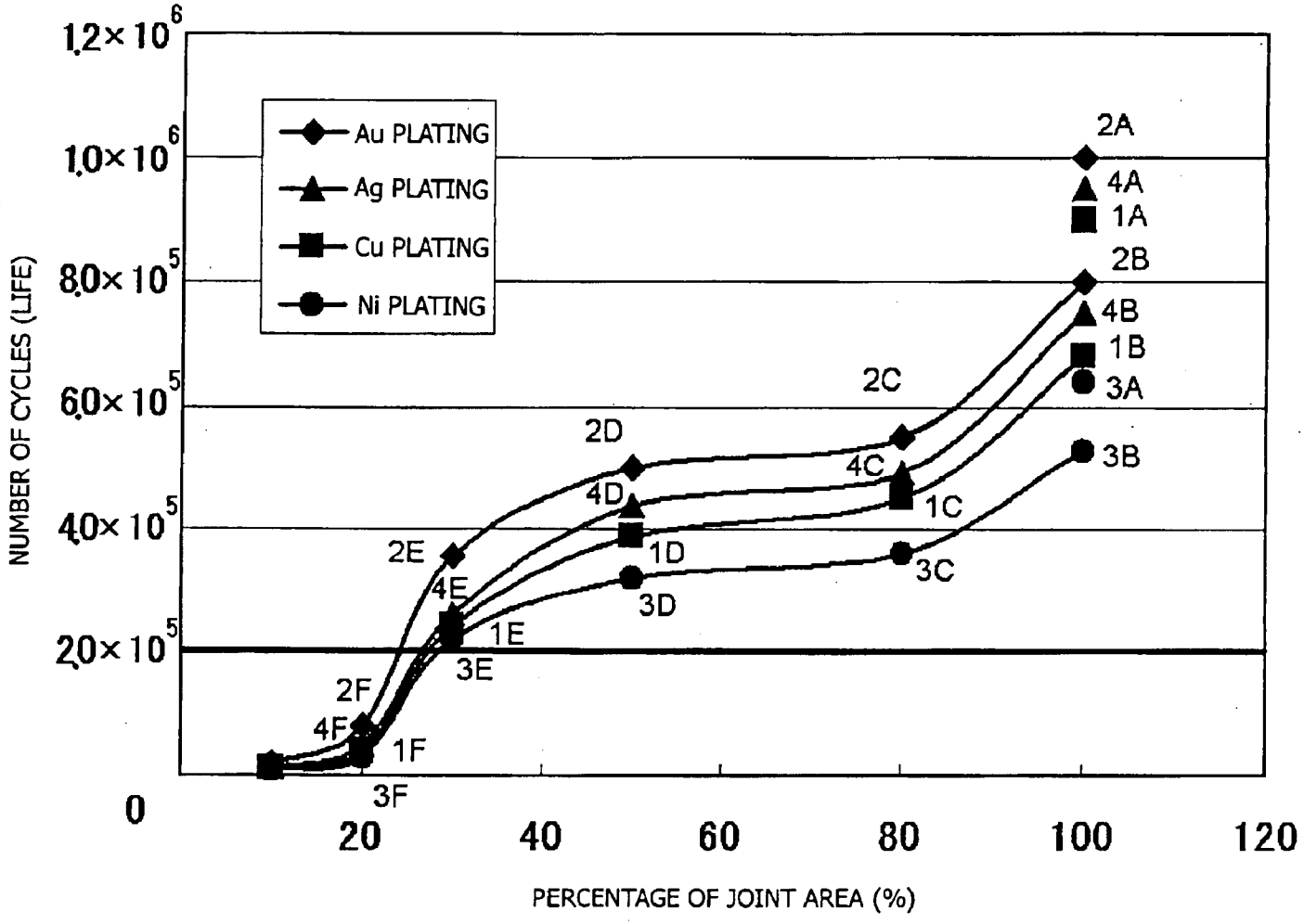
FIG. 10 is a graph showing the results of Experiment Examples.

The ceramic heaters 1 were evaluated for whether or not a defect, such as cracking, occurred thereon as a result of press fitting operation. Then, a heating durability test was carried out. Assemblies each consisting of the ceramic heater 1 and metallic fitting members were placed in an unillustrated thermal cycle processing furnace. The heating durability test carried out thermal cycling, each cycle consisting of application of heat for 30 seconds so as to attain a joint portion temperature of 450° C. and subsequent cooling for 30 seconds so as to attain a joint portion temperature of 50° C. The above cycle was repeated until contact resistance increased. FIG. 10 shows the test results.

In Experimental Example A of FIG. 9B in which the first terminal ring 14 was prepared such that the available contact area of its metal layer 41 is greater than the area of the first heater terminal 12*a*; i.e., S=s, as in the case of the second terminal ring 3 whose metal layer 41 has an available contact area s greater than the exposed-portion area S of the second heater terminal 12*b*, an increase in contact resistance was not observed at all even when the number of thermal cycles exceeded 800,000, indicating that electrical connection is reliably established. As in the case of Experimental Example A, Experimental Example B of FIG. 9B accomplishes S=s. However, since the size of the metal layer 41 is the minimum to cover the first heater terminal 12*a*, as a result of subjection to repeated thermal cycling, slight formation of an oxide film was observed on the arcuate end edges of the first heater terminal 12*a* (upper and lower ends of the first heater terminal 12*a* in Experimental Example B of FIG. 9B). Thus, the test result of Experimental Example B is inferior to that of Experimental Example A. However, according to the criteria of glow plug reliability, if contact resistance does not rise after subjection to more than 200,000 thermal cycles in the present test, the glow plug is judged to be highly reliable. Therefore, Experimental Example B attains a sufficient effect of suppressing an increase in contact resistance.

As is apparent from the test results of FIG. 10, when the area of a plated portion of the first terminal ring 14 which plated portion is in contact with the first heater terminal 12*a* is 30% or more of the surface area of the first heater terminal 12*a*, an increase in contact resistance can be reduced, and thus such plating is effective. Of course, even when the area of a portion of a metal layer which portion is in contact with the first heater terminal 12*a* is less than 30% of the surface area of the first heater terminal 12*a*, the effect of reducing an increase in contact resistance is still attained. However, from the viewpoint of a glow plug, the contact area is preferably 30% or more of the surface area of the first heater terminal 12*a*. This also applies to the condition of contact between the second heater terminal 12*b* and the second terminal ring 3.

In the case of Experimental Example 1F of FIG. 9B in which S>s (=0.2S), formation of an oxide layer was observed on a portion of the first heater terminal (first exposed portion) 12*a* which portion was exposed and was not in contact with the metal layer 41 formed on the inner circumferential surface of the first terminal ring 14. As a result of subjection to repeated thermal cycling, the oxide layer propagated to the contact portion between the first heater terminal 12*a* and the metal layer 41, resulting in an increase in contact resistance before the number of thermal cycles reached 200,000.

Experimental Example 2

Next, measurement similar to that of Experimental Example 1 was carried out for the case where Au, which is the lowest in ionization tendency, was plated on the inner circumferential surface of a metal fitting member. FIG. 10 also shows the measurement results (2A to 2F).

Comparison between the above measurement results and the test results of Experimental Example 1 reveals that the lower the ionization tendency of the metal layer 41, the greater the effect of suppressing an increase in contact resistance at a contact portion between the metal layer 41 and a heater terminal. As is apparent from FIG. 10, Ni and Ag (Ni: 3A to 3F; Ag: 4A to 4F), which are lower than Ni in ionization tendency, exhibit contact-resistance-increase-suppressing performance proportional to the degree of ionization tendency. Specifically, in comparison under the same conditions of use, the lower the ionization tendency, the longer the life; and even in use at higher temperatures, durability can be expected to be maintained at substantially the same level. However, in actual use on a diesel engine, ionization tendency equal to or lower than that of Ni is sufficient in terms of attainment of the contact-resistance-increase-suppressing effect. From the viewpoint of both performance and cost, Cu plating is appropriate. Thus, from the viewpoint of, for example, performance, life, and cost, a metal not higher than Ni in ionization tendency, such as Ni, Ag, Cu, or Au, can be used to form the metal layer 41. Only when particularly high performance and long life are required, a metal not higher than H in ionization tendency, such as Ag or Au, may be used, the metals not reacting with high-temperature oxygen and water vapor.

Next, the thickness of the metal layer 41 was verified. First, the metal layers 41 of different thicknesses were formed on respective first terminal rings 14 each having an inside diameter of 3.3 mm, by a plating process similar to that of Experimental Example 1. The first terminal rings 14 were attached, in the manner of Experimental Example 1A, to respective ceramic heaters 1 by press fitting, thus preparing test samples. Then, contact resistance associated with the first terminal rings 14 was obtained by the aforementioned method. A test sample on which no plating layer was formed was prepared as a Comparative Example. Contact resistance was measured for the test samples at the room temperature, after application of heat of 400° C. for 100 hours, after application of heat of 500° C. for 100 hours, and after application of heat of 600° C. for 100 hours, whereby a change in contact resistance was examined. Table 1 shows the measurement results.

TABLE 1

| | First terminal ring | | | | | Contact resistance (mΩ) | | | |
|---|---|---|---|---|---|---|---|---|---|
| | | Inside | | Metal layer | | Initial | | | |
| | Ceramic heater | dia. d1 (mm) | Material | Material | Thickness (μm) | (room temp.) | 400° C. | 500° C. | 600° C. |
| Comparative Example 3-1 | 3.5 | 3.3 | SUS630 | None | | 16 | 16 | 192 | 2304 |
| Example 3-2 | ↑ | ↑ | ↑ | Ni strike + Cu plating | 0.1 | 4 | 12 | 50 | 1000 |
| Example 3-3 | ↑ | ↑ | ↑ | ↑ | 0.2 | 5 | 6 | 8 | 12 |
| Example 3-4 | ↑ | ↑ | ↑ | ↑ | 0.3 | 2 | 4 | 4 | 4 |
| Example 3-5 | ↑ | ↑ | ↑ | ↑ | 2.7 | 3 | 3 | 3 | 3 |
| Example 3-6 | ↑ | ↑ | ↑ | ↑ | 6.1 | 2 | 2 | 2 | 2 |
| Example 3-7 | ↑ | ↑ | ↑ | ↑ | 10.0 | 5 | 5 | 5 | 5 |
| Example 3-8 | ↑ | ↑ | ↑ | ↑ | 15.0 | 7 | — | — | — |

In the case of Comparative Example 3-1, in which the metal layer 41 was not formed, contact resistance even at the room temperature (at the initial state) is slightly inferior to those of other Examples (3-1 to 3-7), and contact resistance gradually increased with temperature in the course of the test. Thus, sufficient durability cannot be expected from a glow plug that uses the ceramic heater of Comparative Example 3-1. Even when the metal layer 41 is provided, the metal layer 41 needs to have an appropriate thickness.

Specifically, the metal layer 41 formed on the first terminal ring 14 in Example 3-2 has a thickness of 0.1 μm, but the thickness is too small to attain sufficient durability. When the thickness is 0.2 μm (Example 3-3), contact resistance exhibits a slight increase after application of heat of 600° C. for 100 hours, but durability is sufficient for provision of a glow plug with sufficient durability. When the thickness of the metal layer 41 is 0.3 μm to 10 μm as in the case of Examples 3-4 to 3-7, an increase in contact resistance is hardly observed even after the thermal test (even when an increase in contact resistance arises, the increase is very small and raises no problem in terms of durability); thus, this range of thickness is more preferable. However, when the thickness of the metal layer 41 is in excess of 10 μm, clearance becomes insufficient for fitting the first terminal ring 14 plated with the metal layer 41 to the ceramic heater 1, and thus there arises the problem that the metal layer 41 chips. Even when the metal layer 41 does not chip, and durability as measured after the thermal test is sufficiently satisfactory for provision of a glow plug with sufficient durability, there still remains a substantial problem of high cost. Therefore, from the viewpoint of durability of a glow plug, the metal layer 41 preferably has a thickness of about 0.2 μm to 10 μm as in the case of Examples 3-2 to 3-7.

When the thickness of a plating layer serving as the metal layer 41 is less than 0.2 μm, the thickness of the metal layer 41 is too small to maintain the effect of suppressing occurrence of cracking, thereby raising a problem of a drop in deflective strength. When the thickness of the plating layer was in excess of 10 μm, partial exfoliation of the plating layer was observed in the course of press fitting. This indicates that even when the plating layer is formed into a thickness in excess of 10 μm, an increase in time and cost required for plating merely results, and enhancement of the effect of the plating layer is hardly attained.

As is apparent from the above description, when a plating layer that serves as the metal layer 41 in the present invention is adjusted in thickness to a range of 0.2 μm to 10 μm, the effect of the metal layer 41 can be sufficiently exhibited, and cost and time can be suppressed.

As is apparent from the above experiment results, the glow plug 50 of the present invention can maintain high reliability over a long term.

What is claimed is:

1. A glow plug comprising:

a ceramic heater assuming a rodlike form and having a resistance-heating element embedded in a distal end portion thereof;

a first metallic fitting member externally joined to a rear end portion of the ceramic heater in such a manner as to surround an outer circumferential surface of the rear end portion;

a second metallic fitting member disposed on a side toward a distal end of the ceramic heater in relation to the first metallic fitting member and externally joined to the ceramic heater in such a manner as to surround an outer circumferential surface of the ceramic heater; and a pair of electric conductors embedded in the ceramic heater so as to electrically connect the resistance-heating element and the first and second metallic fitting members, one electric conductor having a first exposed portion joined to the first metallic fitting member, and the other electric conductor having a second exposed portion joined to the second metallic fitting member, wherein a metal layer not higher than Ni in ionization tendency is formed on an inner circumferential surface of the first metallic fitting member and on an inner circumferential surface of the second metallic fitting member, the inner circumferential surfaces facing the first and second exposed portions, respectively; and the metal layers are in contact with the corresponding first and second exposed portions.

2. A glow plug according to claim 1, wherein the metal layer contains at least either Ag or Au and is not higher than H in ionization tendency.

3. A glow plug according to claim 1, wherein the metal layer has a thickness of 0.2 μm to 10 μm.

4. A glow plug according to claim 1, wherein the metal layer has a thickness of 0.3 μm to 10 μm.

5. A glow plug according to claim 1, wherein said electric conductors contain at least either tungsten (W) or molybdenum (Mo).

6. A glow plug according to claim 1, wherein said metal layer contacts at least 30% of the area of an exposed portion.

7. A method of manufacturing a glow plug which comprises a ceramic heater assuming a rodlike form and having a resistance-heating element embedded in a distal end portion thereof; a first metallic fitting member externally joined to a rear end portion of the ceramic heater in such a manner as to surround an outer circumferential surface of the rear end portion; a second metallic fitting member disposed on a side toward a distal end of the ceramic heater in relation to the first metallic fitting member and externally joined to the ceramic heater in such a manner as to surround an outer circumferential surface of the ceramic heater; and a pair of electric conductors embedded in the ceramic heater so as to electrically connect the resistance-heating element and the first and second metallic fitting members, the electric conductors containing at least either W or Mo, one electric conductor having a first exposed portion joined to the first metallic fitting member, and the other electric conductor having a second exposed portion joined to the second metallic fitting member, the method comprising the steps of:

forming a metal layer not higher than Ni in ionization tendency on an inner circumferential surface of the first metallic fitting member and on an inner circumferential surface of the second metallic fitting member, the inner circumferential surfaces facing the first and second exposed portions, respectively; and joining the first and second metallic fitting members to the ceramic heater such that the metal layers come into contact with the corresponding first and second exposed portions.

8. A method of manufacturing a glow plug according to claim 7, wherein the step of forming a metal layer is to form a metal layer containing at least Ag or Au and not higher than H in ionization tendency.

9. A method of manufacturing a glow plug according to claim 7, wherein the metal layers and the corresponding first and second exposed portions are joined together such that an area of contact between the metal layer and the corresponding exposed portion is 30% or more of an area of the exposed portion.

* * * * *